US008454203B2

(12) United States Patent
Yoshikawa et al.

(10) Patent No.: US 8,454,203 B2
(45) Date of Patent: Jun. 4, 2013

(54) DISCHARGE LAMP UNIT WITH HEAT DISSIPATION STRUCTURE

(75) Inventors: Syota Yoshikawa, Kariya (JP); Yoshihiro Wanda, Okazaki (JP)

(73) Assignee: Denso Corporation, Kariya (JP)

( * ) Notice: Subject to any disclaimer, the term of this patent is extended or adjusted under 35 U.S.C. 154(b) by 420 days.

(21) Appl. No.: 12/798,602

(22) Filed: Apr. 7, 2010

(65) Prior Publication Data

US 2010/0259936 A1 Oct. 14, 2010

(30) Foreign Application Priority Data

Apr. 8, 2009 (JP) ..... 2009-094047

(51) Int. Cl.
*F21V 29/00* (2006.01)
*F21V 19/00* (2006.01)
*F21V 21/00* (2006.01)

(52) U.S. Cl.
USPC ..... 362/294; 362/382

(58) Field of Classification Search
None
See application file for complete search history.

(56) References Cited

U.S. PATENT DOCUMENTS

| | | | | |
|---|---|---|---|---|
| 7,258,464 | B2 * | 8/2007 | Morris et al. | 362/294 |
| 2003/0006706 | A1 | 1/2003 | Yamaguchi et al. | |

FOREIGN PATENT DOCUMENTS

| | | |
|---|---|---|
| CN | 2606281 | 3/2004 |
| JP | 06-069675 | 3/1994 |
| JP | 2002-008417 | 1/2002 |
| JP | 2002-109951 | 4/2002 |
| JP | 2003-022702 | 1/2003 |
| JP | 2003-317535 | 11/2003 |
| JP | 2004-200140 | 7/2004 |
| JP | 2008-037063 | 2/2008 |

OTHER PUBLICATIONS

Machine translation of JP2002-109951A published Dec. 4, 2002.*
Office Action dated Nov. 16, 2011 in corresponding Chinese Application No. 2010 10149936.2.
Office Action dated Dec. 21, 2010, in corresponding Japanese Application No. 2009-094047, with English translation thereof.

* cited by examiner

*Primary Examiner* — Britt D Hanley
(74) *Attorney, Agent, or Firm* — Harness, Dickey & Pierce, PLC

(57) ABSTRACT

In a discharge lamp unit, a casing member arranged such that the casing member holds a circuit board therein and holds a discharge lamp supporting section being exposed outside of the casing member. A thermal absorption protect layer is formed on the surface on the side on which the discharge lamp supporting section is exposed. The thermal absorption protect layer allows the casing member to inhibit absorption of radiant heat induced by the discharge lamp. Since the thermal absorption protect layer inhibits the casing member from absorbing the radiant heat from the discharge lamp, the amount of heat generated by the discharge lamp reaching the circuit board may be reduced. Therefore, the circuit board is not easily heated.

8 Claims, 4 Drawing Sheets

DISCHARGE LAMP UNIT WITH HEAT DISSIPATION STRUCTURE

CROSS-REFERENCE TO RELATED APPLICATION

This application is related to Japanese Patent Application No. 2009-94047 filed on Apr. 8, 2009, the contents of which are hereby incorporated by reference.

BACKGROUND OF THE INVENTION

1. Field of the Invention

The present invention relates to a discharge lamp unit. In particular, the present invention relates to a discharge lamp unit including a supporting member that supports a discharge lamp and a circuit board that supplies power to the discharge lamp.

2. Description of the Related Art

Conventionally, a discharge lamp unit is designed taking into consideration heat conduction within the discharge lamp. For example, in Japanese Patent Laid-open Publication No. 2003-022702, as the above-described discharge lamp unit, a technology is disclosed in which the material used to form a casing that houses a circuit board is changed to a material that does not easily conduct heat to inhibit conduction of heat generated by a discharge lamp to the circuit board.

However, in the above-described discharge lamp unit, the casing member is heated by radiant heat induced by the discharge lamp. Even when the material used to form the casing member is changed to a material that does not easily conduct heat, the heat generated by the discharge lamp tends to reach the circuit board when the casing member is continuously heated over a long period.

In light of the above-described problem, an object of the present invention is to provide a technology for further inhibiting heat generated by the discharge lamp from reaching the circuit board in a discharge lamp unit.

SUMMARY OF THE INVENTION

To achieve the above-described object, the discharge lamp unit includes a discharge lamp radiating light, inducing radiant heat; a supporting member supporting the discharge lamp; a circuit board supplying power to the discharge lamp being supported by the supporting member to allow the discharge lamp to radiate light; a casing member that holds the circuit board therein and holds the supporting member to be exposed outside of the casing member; and a thermal absorption protect section being formed on a surface of the casing member on a side on which the supporting member being exposed, to allow the casing member to inhibit absorption of the radiant heat induced by the discharge lamp.

In a discharge lamp unit such as this, the thermal absorption protect section inhibits absorption of radiant heat from the discharge lamp by the casing member. Therefore, the amount of heat generated by the discharge lamp reaching the circuit board may be reduced. As a result, the circuit board is not easily heated.

As a specific configuration of the thermal absorption protect section, for example, the thermal absorption protect section is merely required to be configured in a layered state such that at least a portion of the surface of the casing member on the side on which the supporting member is exposed is covered. The thermal absorption protect section may be configured as a reflective layer that facilitates reflection of radiant heat from the discharge lamp or a heat-insulating layer that prevents heat absorbed by the surface of the casing material from being transferred within the casing member.

In the discharge lamp unit described in the present invention, a heat-radiation section that facilitates radiation of heat in the casing member to the outside of the casing member is formed on at least a portion of a surface of the casing member excluding the surface on the side on which the supporting member is exposed.

In a discharge lamp unit such as this, because the heat-radiation section is provided, the heat in the casing member is more easily radiated to the outside of the casing member. As a configuration of the heat-radiation section, for example, the heat-radiation section may be a heat-radiating layer configured such that material surface thermal emissivity, and thermal conductivity between air and the heat-radiating layer are higher than those of the casing material. Alternatively, the heat-radiation section may be a heat-radiating member having a plurality of projections and recesses, or projecting sections to increase a surface area of the casing member.

In the discharge lamp unit described above, the casing member is configured by a first casing member including the surface on the side on which the supporting member is exposed mated with a second casing member not including the surface on the side on which the supporting member is exposed. The thermal absorption protect section may be formed on the surface of the first casing member, and the heat-radiation section may be formed on the surface of the second casing member.

In a discharge lamp unit such as this, when the casing member is configured by a plurality of members, the casing member can be configured such that the thermal absorption protect section and the heat-radiation section do not span a plurality of members. As a result, a manufacturing procedure performed when forming the thermal absorption protect section and the heat-radiation section in each member may be simplified.

Moreover, in the discharge lamp unit described above, the absorption protect section may be configured such that a heat-insulating layer made of a material having lower thermal conductivity than the casing member and a reflective layer forming a mirrored surface are laminated in order from the casing member side.

In a discharge lamp unit such as this, because the reflective layer reflects the radiant heat from the discharge lamp, the surface (reflective layer) of the casing member is not easily heated. Furthermore, because the heat-insulating layer prevents the heat absorbed by the surface of the casing member from reaching the interior of the casing member, the interior of the casing member is further less likely to be heated.

DETAILED DESCRIPTION OF THE PREFERRED EMBODIMENTS

Preferred embodiments of the present invention will hereinafter be described with reference to the drawings.

Figure 1:
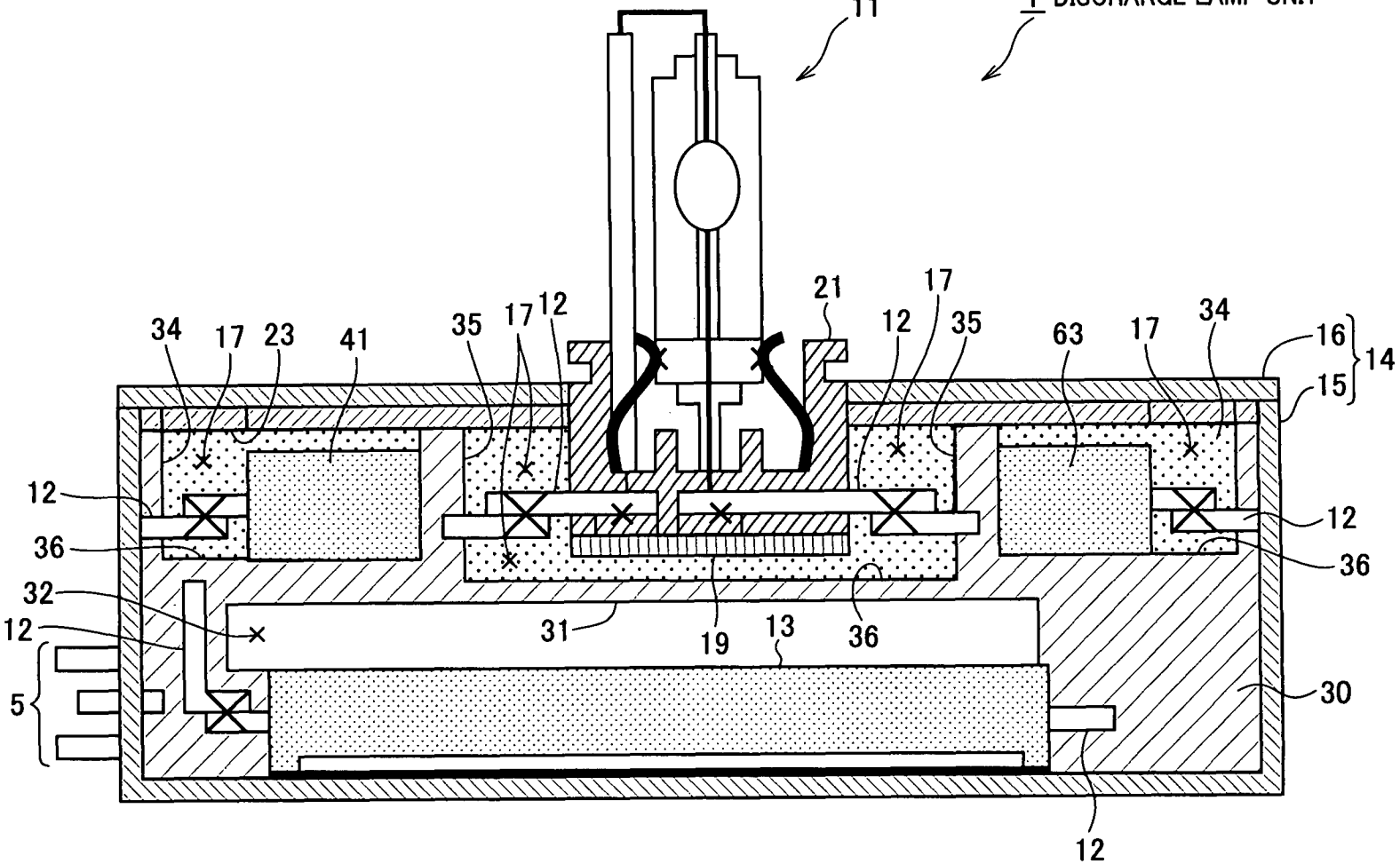
FIG. 1 is a center cross-sectional view showing a discharge lamp unit according to an embodiment.

FIG. 1 is a center cross-sectional view of a discharge lamp unit 1 to which the present invention is applied. FIG. 2 is an enlarged cross-sectional view of a casing member 14.

As shown in FIG. 1, the discharge lamp unit 1 is configured such that each constituent element for supplying power to light a discharge lamp 11 is housed within the casing member 14. More specifically, the casing member 14 is made of, for example, aluminum. The casing member 14 houses therein a circuit board 13 including an integrated circuit, such as an integrated circuit (IC) chip, circuit components, such as a coil and a capacitor, wirings 12 that electrically connect the circuit board 13 and the circuit components, and the like. The casing member 14 holds a discharge lamp supporting section 21 (supporting member) for supporting the discharge lamp 11 in a state in which the discharge lamp supporting section 21 is exposed outside of the casing member 14.

Here, the casing member 14 is configured such that a cover member 16 (first casing member) and a main member 15 (second casing member) are butted against each other. The cover member 16 includes the surface on the side on which the discharge lamp supporting section 21 that supports the discharge lamp 11 is exposed (upper side in FIG. 1). The main member 15 is on the circuit board 13 side (lower side in FIG. 1) and does not include the surface on the side on which the discharge lamp supporting section 21 is exposed. In the casing member 14, the cover member 16 functions as an electromagnetic interference (EMI) shield that prevents external noise from infiltrating the casing member 14. The main member 15 functions as an EMI shield. In addition, the main member 15 serves as a heat sink that radiates heat within the casing member 14 to the outside of the casing member 14.

A reflective member (not shown) having a concave reflective surface may be disposed in an area between the casing member 14 and the discharge lamp supporting section 21. The reflective member reflects light from the discharge lamp 11 in a forward direction (upward direction in FIG. 1).

Figure 2A:
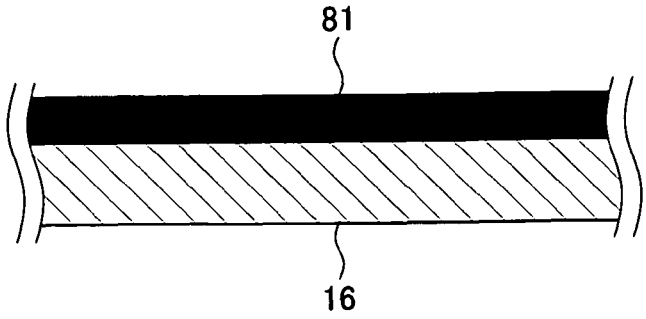
FIGS. 2A to 2C are an enlarged cross-sectional view showing a casing member.

In the casing member 14, as shown in FIG. 2A, a thermal absorption protect layer 81 (thermal absorption protect section) is formed on the surface of the cover member 16 on the side on which the discharge lamp supporting section 21 is exposed. The thermal absorption protect layer 81 is formed, for example, by the surface of the cover member 16 being chrome-plated. The chrome-plating layer forms a mirrored surface that reflects radiant heat. As a result of this configuration, the casing member 14 (cover member 16) does not easily absorb radiant heat induced by the discharge lamp 11.

Figure 2B:
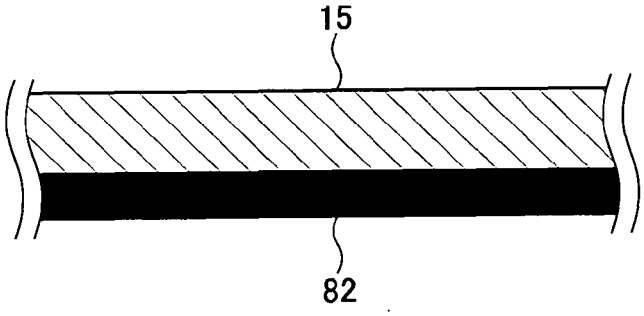

In the main member 15, as shown in FIG. 2B, a heat-radiating layer 82 (heat-radiation section) is formed that facilitates radiation of heat in the casing member 14 to the outside of the casing member 14. Here, the heat-radiating layer 82 is configured by a material, such as alumite (alumina), having a higher material surface thermal emissivity than the main member 15. In other words, the heat-radiating layer 82 is formed by alumite processing being performed on the surface of the main component 15.

The thermal emissivity indicates a ratio of the thermal radiation level of a subject object (aluminum or alumite, herein) to the thermal radiation level of a perfect black body. When the main member 15 is made of aluminum, the thermal emissivity of aluminum is about 0.05, whereas the thermal emissivity of alumite is about 0.95.

In other words, this indicates that heat within the casing member 14 is more efficiently radiated to the outside of the casing member 14 when the surface of the main member 15 is made of alumite, rather than aluminum. The heat-radiating layer 82 is formed on the overall surface of the area in the main member 15 that comes into contact with outside air (air outside of the casing member 14).

The space within the casing member 14 is divided into a plurality of spaces by a molded plastic 30 that is injection-molded into a predetermined shape. In other words, the molded plastic 30 includes a dividing wall 31 that divides the space within the casing member 14 on a plane perpendicular to the light axis direction of the discharge lamp 11, between the discharge lamp supporting section 21 and the circuit board 13.

The circuit board 13 is disposed in a first portion (a space below the dividing wall 31 in FIG. 1) partitioned by the dividing wall 31. The discharge lamp supporting section 21 is disposed in a second portion (a space above the dividing wall 31 in FIG. 1) partitioned by the dividing wall 31. In the first portion, a hollow section 32 in which constituent elements, such as circuit components, are not disposed is formed between the dividing wall 31 and the circuit board 13.

In the second portion of the casing member 14, numerous bowl-shaped spaces (three spaces in FIG. 1) are formed by side walls 34 and a plurality of partitioning walls 35 of the molded plastic 30 formed in parallel with the light axis direction of the discharge lamp 11. Each of the bowl-shaped spaces configures a component mounting section 36 for mounting a circuit component. "Bowl-shaped" refers to a shape including side wall portions (the side wall 34 and the partitioning wall 35) surrounding a bottom portion (a surface of the dividing wall 31 on the discharge lamp supporting section 21 side), in which the side opposing the bottom portion of the side wall portion is open.

A liquid filling material 17, such as potting resin, is poured into each component mounting section 36, such as those described above, after a predetermined circuit component is disposed therein. The discharge lamp supporting section 21 is integrally formed with a resin cover section 23 that covers at least some of the component mounting sections 36. The discharge lamp supporting section 21 is positioned at a fixed distance away from the dividing wall 31 without coming into direct contact with the dividing wall 31, by the resin cover 23 being mounted on the side walls 34 and the partitioning walls 35.

According to the present embodiment, a heat-insulating material 19 having lower thermal conductivity than ordinary metals and resins is disposed on the surface of the discharge lamp supporting section 21 on the dividing wall 31 side (lower side in FIG. 1). The above-mentioned filling material 17 fills the area between the heat-insulating material 19 and the dividing wall 31.

A discharge lamp unit 1 such as this enters an operable state by a wiring that supplies power being connected to a connector 5 formed projecting outward in the periphery of the casing member 14. The discharge lamp supporting section 21 and the resin cover section 23 are preferably formed by a material having further lower thermal conductivity, such that the discharge lamp supporting section 21 blocks conductive heat from the discharge lamp 11 and the resin cover section 23 blocks the radiant heat induced by the discharge lamp 11.

Figure 3:
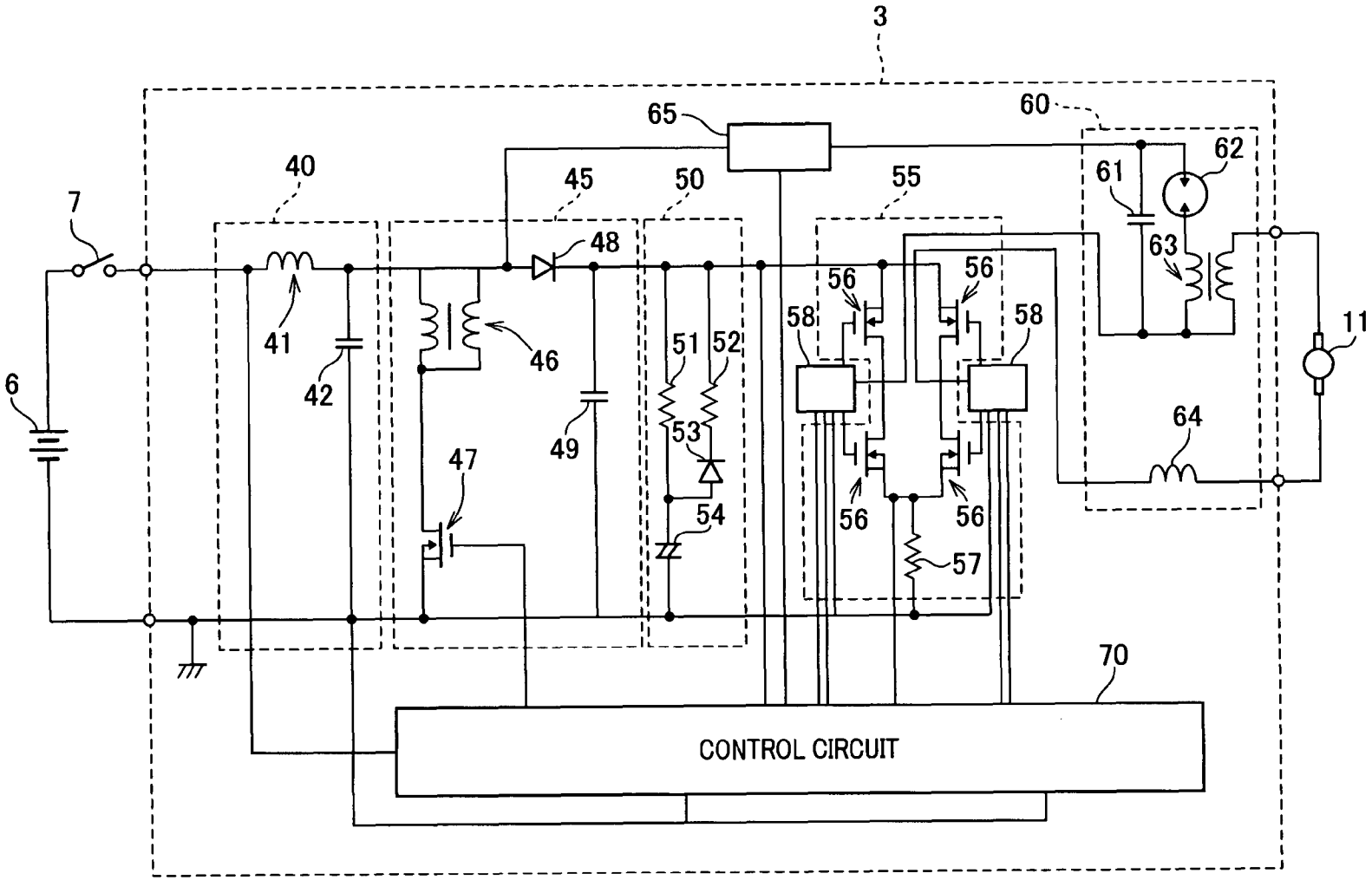
FIG. 3 is a circuit diagram showing a light-emitting circuit enabling a discharge lamp to emit light.

Next, a circuit configuration configuring the discharge lamp unit 1 will be described with reference to FIG. 3. FIG. 3 is a circuit diagram of a light-emitting circuit 3 that lights the discharge lamp 11. As shown in FIG. 3, a battery 6 and a switch 7 are provided outside of the discharge lamp unit 1. Power from the battery 6 is supplied to the discharge lamp unit 1 by an operator turning ON the switch 7.

As shown in FIG. 3, the light-emitting circuit 3 of the discharge lamp unit 1 includes a filter circuit 40, a direct current/direct current (DC/DC) converter circuit 45, a lighting auxiliary circuit 50, a H-bridge circuit 55 (a type of bridge circuit, so-called H-bridge), a high-voltage generation circuit 60, and a control circuit 70.

The filter circuit 40 includes an input coil 41 and an input capacitor 42. The filter circuit 40 is configured to serve as a smoothing circuit that smoothes power supply voltage received from the battery 6.

The DC/DC converter circuit 45 includes a DC/DC transformer 46, a power metal-oxide semiconductor (MOS) transistor 47 that is a power device, a diode 48, and a capacitor 49. The DC/DC converter circuit 45 is configured to serve as a converter circuit that boosts the power supply voltage (such as 12V) to a lamp supply voltage (such as 40V).

The lighting auxiliary circuit 50 includes two resistors 51 and 52, a diode 53, and a storage capacitor 54. The resistors 51 and 52 are connected in parallel to a power supply side terminal. The diode 53 is serially connected to one resistor 52. The storage capacitor 54 is connected to the other resistor 51 and the diode 53. The lighting auxiliary circuit 50 is a circuit that temporarily supplies power required to light the discharge lamp 11 to the discharge lamp 11. The storage capacitor 54 provides a function for storing required power.

The H-bridge circuit 55 includes four power transistors 56 and a resistor 57 disposed to serve as a current detection resistor. The H-bridge circuit 55 is controlled by drivers 58 that receive operating signals from the control circuit 70 and turn ON and OFF power transistors 56. As a result of the control by the drivers 58, output from the H-bridge circuit 55 is converted from a direct current to an alternating current (which, however, has a rectangular waveform).

The high-voltage generation circuit 60 includes a high-voltage generation capacitor 61, a spark gap 62, a starter transformer 63, and a noise reduction coil 64. The high-voltage generation capacitor 61 charges the current flowing to the primary coil side of the starter transformer 63. The spark gap 62 switches the discharge of the high-voltage generation capacitor 61.

Then, the starter transformer 63 generates a starting voltage (such as 25 kV) for initiating lighting of the discharge lamp 11. A high voltage from a boosting circuit 65 that receives operating signals from the control circuit 70 is applied to the spark gap 62, and the spark gap 62 conducts power performs conduction at a timing at which the voltage applied to the spark gap 62 reaches a predetermined voltage. The control circuit 70 includes a semiconductor device that controls circuit elements.

Circuit components within the light-emitting circuit 3, such as the control circuit 70, the H-bridge circuit 55, and the drivers 58, are mounted on the above-described circuit board 13.

In the discharge lamp unit 1 described in detail above, in the casing member 14 that holds the circuit board 13 therein and holds the discharge lamp supporting section 21 in a state in which the discharge lamp supporting section 21 is exposed outside of the casing member 14, the thermal absorption protect layer 81 that inhibits absorption of radiant heat induced by the discharge lamp 11 by the casing member 14 is formed on the surface on the side on which the discharge lamp supporting section 21 is exposed.

In a discharge lamp unit 1 such as this, the thermal absorption protect layer 81 inhibits absorption of the radiant heat induced by the discharge lamp 11 by the casing member 14. Therefore, the amount of heat that reaches the circuit board 13 within the amount of heat generated by the discharge lamp 11 may be reduced. As a result, the circuit board 13 is not easily heated.

Moreover, in the discharge lamp unit 1, the heat-radiating layer 82 that facilitates radiation of heat in the casing member 14 to the outside of the casing member 14 is formed on at least a portion of the surface of the casing member 14 excluding the surface on the side on which the discharge lamp supporting section 21 is exposed.

In a discharge lamp unit 1 such as this, because the heat-radiating layer 82 is provided, the heat in the casing member 14 is more easily discharged to the outside of the casing member 14.

The casing member 14 in the discharge lamp unit 1 is configured by the cover member 16 including the surface on the side on which the discharge lamp supporting member 21 is exposed and the main member 15 that does not include the surface on the side on which the discharge lamp supporting member 21 is exposed being mated. The thermal absorption protect layer 81 is formed on the surface of the cover member 16, and the heat-radiating layer 82 is formed on the surface of the main member 15.

In the discharge lamp unit 1 such as this, when the casing member 14 is configured by a plurality of members, the casing member 14 can be configured such that the thermal absorption protect layer 81 and the heat-radiating layer 82 do not span a plurality of members. As a result, a manufacturing procedure performed when forming the thermal absorption protect layer 81 and the heat-radiating layer 82 in each member can be simplified.

VARIATION EXAMPLES

Embodiments of the present invention are not limited in any way by the above-described embodiment. Various embodiments are possible without departing from the technical scope of the present invention.

Figure 2C:
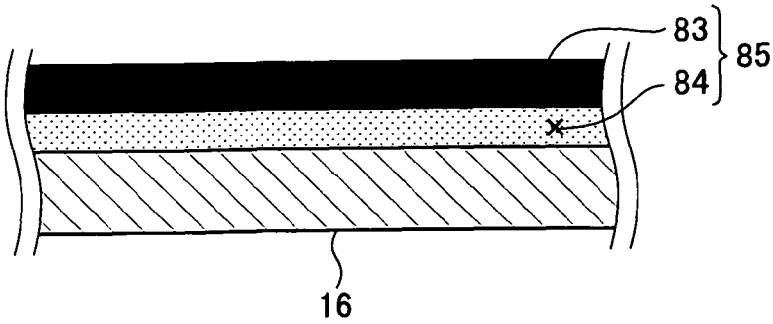

For example, in the discharge lamp unit 1 according to the above-described embodiment, it is explained that the thermal absorption protect layer 81 covering the surface of the cover member 16 has a single-layer structure formed by chrome-plating. However, a multiple-layer structure may be used. When the thermal absorption protect layer 81 has a multiple-layer structure, as shown in FIG. 2C, a thermal absorption protect layer 85 (thermal absorption protect section) is configured such that a heat-insulating layer 84 made of a material having lower thermal conductivity than that of the casing member 14 and a reflective layer 83 forming a mirrored surface are laminated in order from the casing member 14 side.

In this instance, as the heat-insulating layer 84, a ceramic-coating layer is used that is made of a ceramic having lower thermal conductivity than ordinary metals. As the reflective layer 83, a chrome-plating layer or a nickel-plating layer is used.

The reflective layer 83 and the heat-insulating layer 84 can further have multiple-layer structures. For example, when the reflective layer 83 has a multiple-layer structure, the reflective layer 83 may be configured by, for example, a chrome-plating layer and a nickel-plating layer.

In a discharge lamp unit such as this, because the reflective layer 83 reflects radiant heat from the discharge lamp 11, the surface (reflective layer) of the casing member 14 is not easily heated. Moreover, the heat-insulating layer 84 prevents heat absorbed by the surface of the casing member 14 from being transferred within the casing member 14. Therefore, the interior of the casing member 14 is further less likely to be heated.

Figure 4:
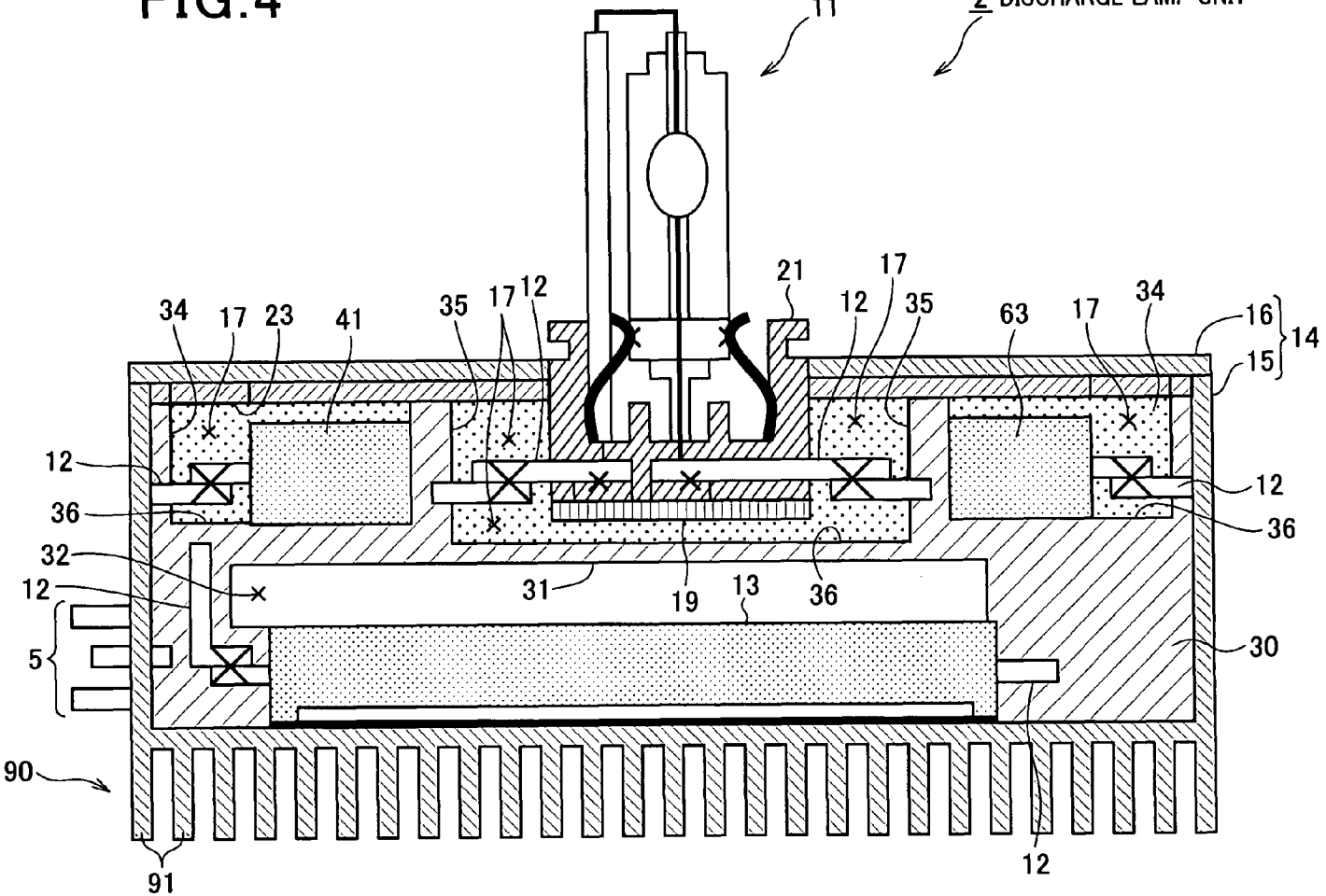
FIG. 4 is a center cross-sectional view of a discharge lamp unit of a variation example.

The discharge lamp unit may be configured as a discharge lamp unit 2 shown in FIG. 4. In other words, in the discharge lamp unit 2, as shown in FIG. 4, in the main member 15 of the casing member 14, a heat-radiating member 90 (heat-radiation section) is included in place of the heat-radiating layer 82. The heat-radiating member 90 has a plurality of projections and recesses or projecting sections (numerous fins 91) for increasing a surface area of the casing member 14. In this configuration as well, because the area in contact with air of the heat-radiating member 90 having a large surface area increases, the heat in the casing member 14 is more easily radiated to the air outside of the casing member 14.

The main member 15 may include the heat-radiating layer 82 and the heat-radiating member 90.

What is claimed is:

1. A discharge lamp unit comprising:

a discharge lamp radiating light, inducing radiant heat;

a supporting member supporting the discharge lamp;

a circuit board supplying power to the discharge lamp being supported by the supporting member to allow the discharge lamp to radiate light;

a casing member that holds the circuit board therein and holds the supporting member to be exposed outside of the casing member;

a thermal absorption protect section being formed on a surface of the casing member on a side on which the supporting member is exposed, to allow the casing member to inhibit absorption of the radiant heat induced by the discharge lamp;

a heat-radiation section formed on at least a portion of a surface of the casing member excluding the surface on the side on which the supporting member is exposed, the heat-radiation section facilitating radiation of heat in the casing member to the outside of the casing member; and a heat-insulating material disposed on a surface of the supporting member to be faced towards the circuit board, a dividing wall disposed between the supporting member and the circuit board in the space within the casing member, the dividing wall dividing the space on a plane perpendicular to a light axis direction of the discharge lamp, wherein the casing member is configured by a first casing member including the surface on the side on which the supporting member is exposed being mated with a second casing member not including the surface on the side on which the supporting member is exposed, and the thermal absorption protect section is formed on a surface of the first casing member, and the heat-radiation section is formed on a surface of the second casing member, and the thermal absorption protect section is configured such that a heat-insulating layer made of a material having a lower thermal conductivity than the casing member and a reflective layer forming a mirrored surface are laminated in order from the casing member side.

2. The discharge lamp unit according to claim 1, wherein the casing member has a space formed therein, the discharge lamp unit further includes:

a hollow section disposed between the dividing wall and the circuit board, the hollow section having no elements used for the discharge lamp unit.

3. The discharge lamp unit according to claim 2, wherein a part of the supporting member is disposed in the space within the casing member, and the supporting member is positioned at a fixed distance away from the dividing wall.

4. The discharge lamp unit according to claim 3, wherein the thermal absorption protect section is formed as a chrome-plating layer.

5. The discharge lamp unit according to claim 2, wherein the thermal absorption protect section is formed as a chrome-plating layer.

6. The discharge lamp unit according to claim 1, wherein the thermal absorption protect section is formed as a chrome-plating layer.

7. The discharge lamp unit according to claim 1, wherein the heat-insulating material is disposed directly on the surface of the supporting member directly between the supporting member and the circuit board.

8. The discharge lamp unit according to claim 7, wherein the surface of the supporting member on which the heat-insulating material disposed is located inside of the casing spaced from a surface of the first casing facing the inside of the casing.

* * * * *